US007606520B2

(12) United States Patent
Dawson

(10) Patent No.: US 7,606,520 B2
(45) Date of Patent: Oct. 20, 2009

(54) SHUTTER FOR A TONER CARTRIDGE FOR USE WITH AN IMAGE FORMING DEVICE

(75) Inventor: Jedediah Taylor Dawson, Lexington, KY (US)

(73) Assignee: Lexmark International Inc., Lexington, KY (US)

( * ) Notice: Subject to any disclaimer, the term of this patent is extended or adjusted under 35 U.S.C. 154(b) by 465 days.

(21) Appl. No.: 11/556,863

(22) Filed: Nov. 6, 2006

(65) Prior Publication Data

US 2008/0107453 A1 May 8, 2008

(51) Int. Cl.
*G03G 15/08* (2006.01)

(52) U.S. Cl. ..... 399/260; 399/262

(58) Field of Classification Search ..... 399/106, 399/258, 260, 262, 263
See application file for complete search history.

(56) References Cited

U.S. PATENT DOCUMENTS

| | | | | |
|---|---|---|---|---|
| 5,441,177 | A | 8/1995 | Yanagisawa | |
| 5,722,014 | A | 2/1998 | Fike | |
| 6,018,638 | A * | 1/2000 | Li | 399/106 |
| 6,044,235 | A | 3/2000 | Hashimoto | |
| 6,072,969 | A | 6/2000 | Yokomori et al. | |
| 6,564,029 | B2 | 5/2003 | Kojima et al. | |
| 6,785,497 | B1 | 8/2004 | Hasebe | |
| 7,062,205 | B2 | 6/2006 | Nagashiro | |
| 7,095,970 | B2 | 8/2006 | Yahagi | |
| 7,421,234 | B2 * | 9/2008 | Ikeda et al. | 399/262 |
| 7,483,656 | B2 * | 1/2009 | Park | 399/258 |
| 2005/0196200 | A1 | 9/2005 | Himes | |

FOREIGN PATENT DOCUMENTS

| | | |
|---|---|---|
| JP | 2004037257 | 2/2004 |
| JP | 2004212434 | 7/2004 |

* cited by examiner

*Primary Examiner*—William J Royer
(74) *Attorney, Agent, or Firm*—David D. Kalish

(57) ABSTRACT

The present application is directed to cartridges for use with an image forming device. The cartridge includes a body with an interior reservoir sized to contain toner, and an outlet to move the toner to the image forming device. A shutter is rotatably connected to the body and movable between a closed orientation to prevent toner from passing from the cartridge and into the image forming device, and an open orientation to allow toner to pass. A biasing mechanism is operatively connected to the shutter and the body of the cartridge. The biasing mechanism urges the shutter towards one of the open and closed orientations.

20 Claims, 5 Drawing Sheets

SHUTTER FOR A TONER CARTRIDGE FOR USE WITH AN IMAGE FORMING DEVICE

BACKGROUND

The present application is directed to toner cartridges and, more specifically, to cartridges with movable shutters to control the movement of toner from the cartridge to an image forming device.

Image forming devices use toner for producing images on a media sheet. The toner may be housed within a cartridge that is removable from the image forming device. Removal and installation of the cartridges may occur during initial start-up of the device, when the toner has been depleted from the cartridge, and miscellaneous other occurrences.

The cartridges should include an outlet through which the toner moves to the image forming device. When the cartridge is inserted, the outlet aligns with a corresponding receptacle in the device and toner can move from the cartridge to the device. The outlet in the cartridge should include a mechanism to control the movement of the toner. The mechanism may include a first position that allows toner to move from the cartridge, such as when the cartridge is properly positioned within the device. The mechanism may also include a second position that prevents toner from moving from the cartridge. The mechanism may be in the second position such as when the cartridge is removed from the device.

The mechanism should be constructed to prevent toner from moving from the cartridge when in the second position. Toner leaks may result in print defects, and toner inadvertently contacting the user or the user workstation. The mechanism should also be constructed in a manner to not adversely affect the overall cost of the cartridge. Cost may be a major factor in the purchasing decisions of consumers when selecting a cartridge.

SUMMARY

The present application is directed to toner cartridges constructed to control the movement of toner to an image forming device. The cartridges may include a body sized to contain the toner with an outlet that leads from the body. A shutter may be positioned to control the movement of the toner through the outlet. A biasing mechanism may be operatively connected to the shutter. The biasing mechanism may urge the shutter towards one of a closed orientation to prevent toner from moving through the outlet, and an open orientation to allow toner to move through the outlet.

DETAILED DESCRIPTION

Figure 1:
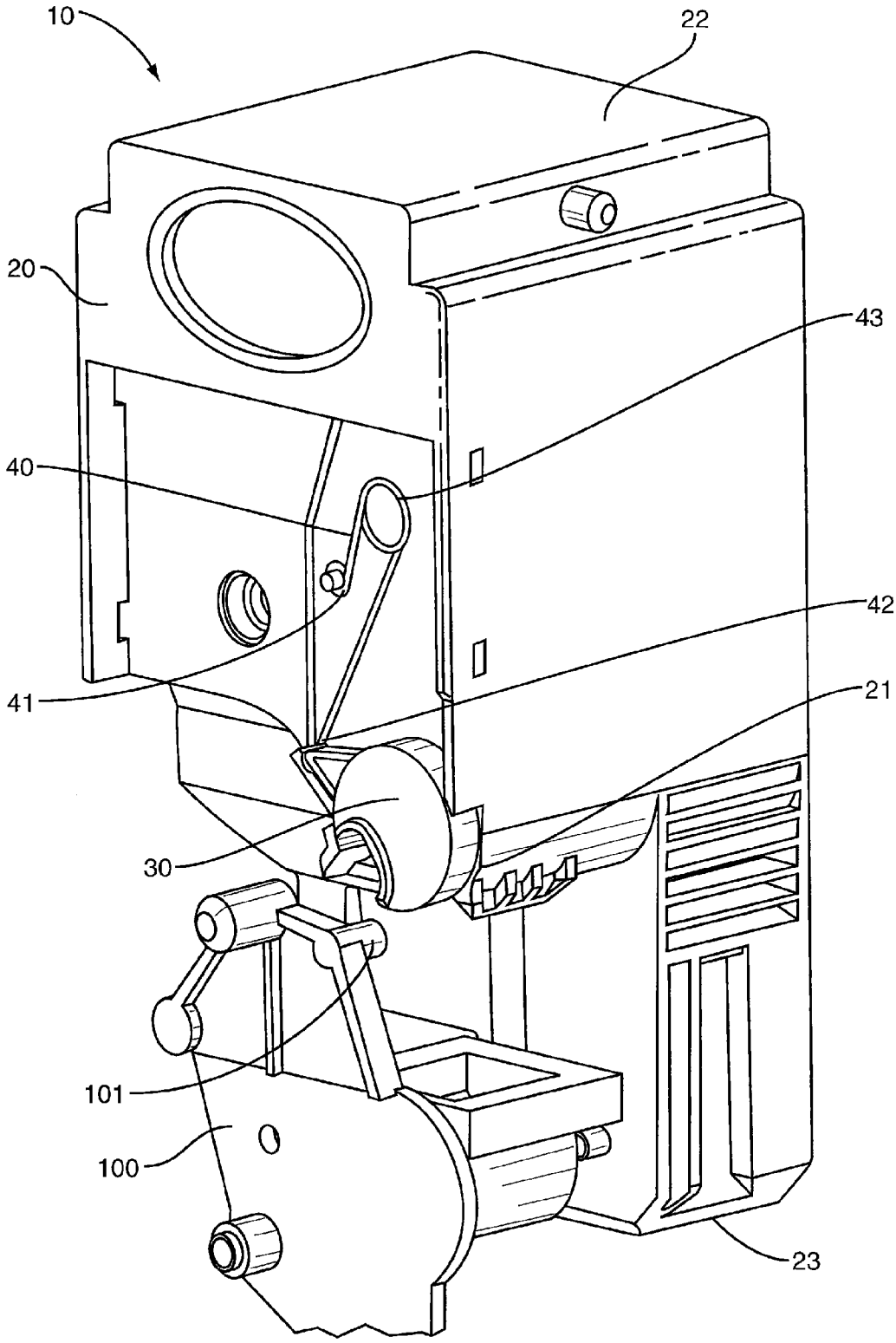
FIG. 1 is a perspective view of a cartridge with a shutter during insertion into an image forming device according to one embodiment.
Figure 5:
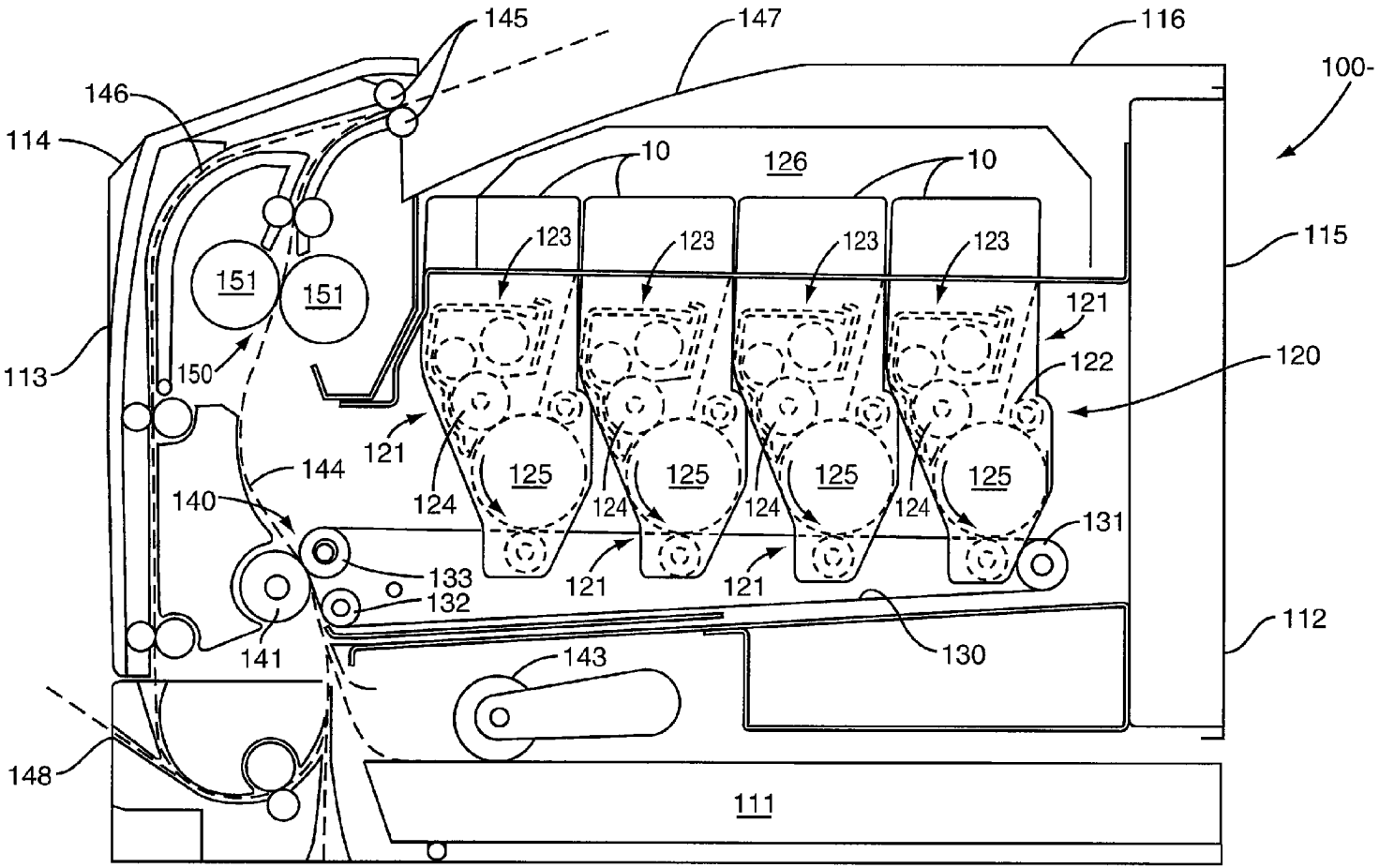
FIG. 5 is a schematic view of an image forming device according to one embodiment.

The present application is directed to toner cartridges with a shutter to control the movement of toner into an image forming device. FIG. 1 illustrates one embodiment of a cartridge 10 that includes a body 20, shutter 30, and a biasing mechanism 40. The body 20 includes an interior reservoir for holding toner that is transferred through an outlet 21 to an image forming device 100 as illustrated in FIG. 5. The shutter 30 is positioned at the outlet 21 to control the toner movement. The shutter 30 may rotate relative to the body 20 between open and closed orientations. The biasing mechanism 40 urges the shutter 30 towards one of the open and closed orientations.

The body 20 includes an interior reservoir sized to contain toner for use in the image forming device 100. As illustrated in FIG. 1, the body 20 includes a top side 22 and a bottom side 23. The cartridge 10 is inserted in a substantially vertical direction as illustrated with arrow A in FIG. 4A with the bottom side 23 being inserted towards the device 100. The outlet 21 extends through an exterior of the body 20 and into the reservoir. The outlet 21 provides a path for the toner to move from the reservoir and to the image forming device 100.

Figure 2:
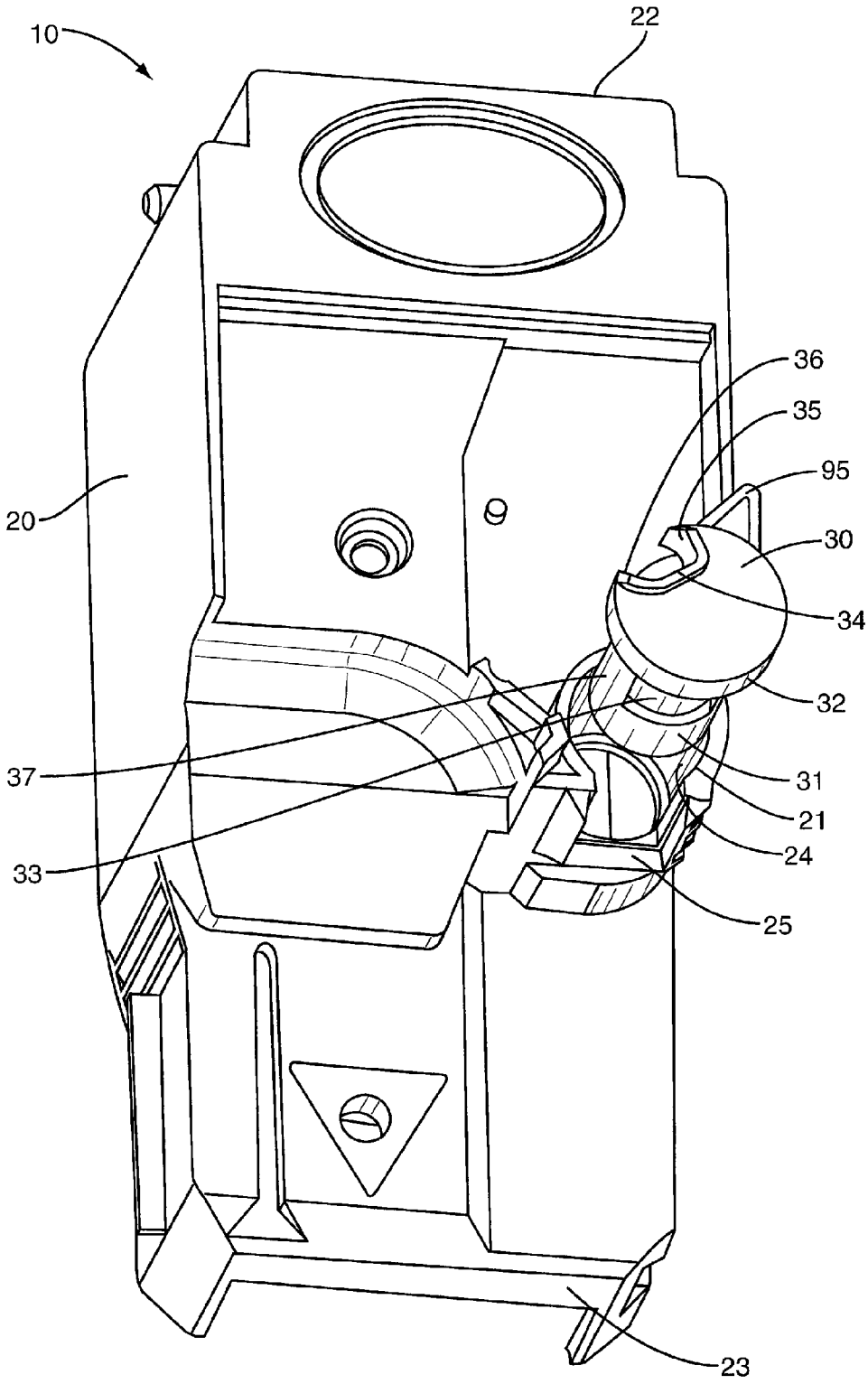
FIG. 2 is an exploded perspective view of a cartridge with a shutter according to one embodiment.
Figure 3:
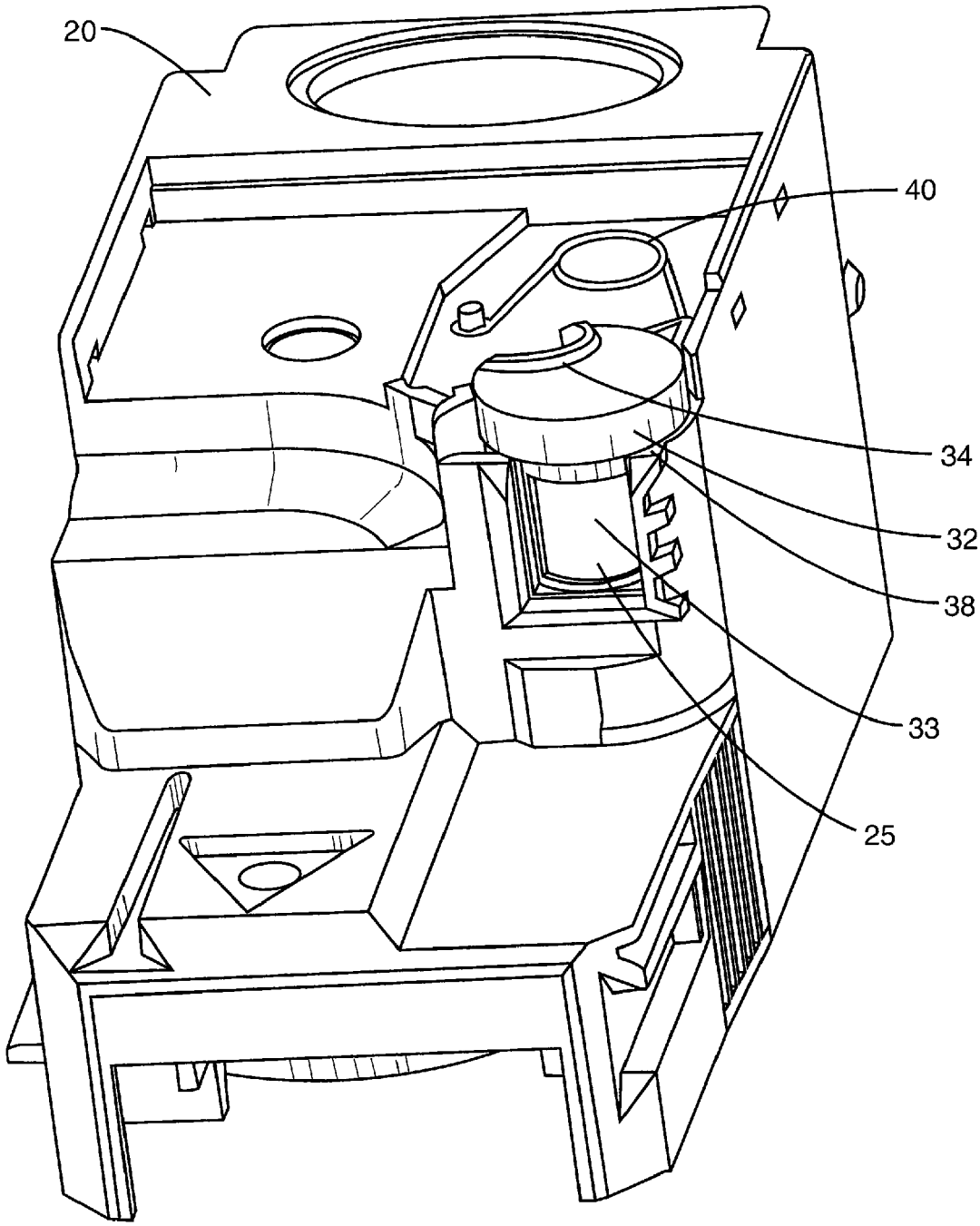
FIG. 3 is a bottom perspective view of a cartridge with a shutter according to one embodiment.

As illustrated in FIGS. 2 and 3, the outlet 21 is formed by a wall 24 that includes an opening 25. In one embodiment, the wall 24 is substantially cylindrical. Wall 24 may be positioned at an intermediate section between the top side 22 and bottom side 23 of the body 20. Opening 25 may face towards the bottom side 23 of the body 20 such that the toner falls via gravity through the opening 25 when being moved to the image forming device 100. An auger (not illustrated) may be positioned within an interior of the wall 24 to move the toner from the reservoir to the opening 25.

Shutter 30 is positioned at the outlet 21 to control the movement of toner from the body 20. FIG. 2 illustrates an exploded view with the shutter 30 removed from the body 20. Shutter 30 includes a cylindrical section 31 and a head 32. The cylindrical section 31 includes a width substantially equal to or smaller than a width of the outlet 21. Head 32 includes a width greater than the outlet 21. This size provides for the cylindrical section 31 to extend into the outlet 21 with the head 32 positioned at an end of the outlet 21. Head 32 may further control the axial position of the shutter 30 within the outlet 21.

The cylindrical section 31 includes an opening 33 that aligns with the opening 25 of the outlet 21 when the shutter 30 is in the open orientation. The opening 33 may be substantially the same size, smaller, or larger than the opening 25. Cylindrical section 31 also includes a solid section 37 axially aligned with the opening 33. The solid section 37 extends over the opening 25 when the shutter 30 is in the closed orientation.

Head 32 is positioned at an end of the cylindrical section 31. As illustrated in FIG. 3, an inner side 38 of the head 32 contacts the body 20 adjacent to the outlet 21. In this position, the head 32 is positioned on the exterior of the body 20 with the cylindrical section 31 within the outlet 21. Head 32 may also include a cam section 34 that contacts the image forming device 100 as will be described in detail below. In one embodiment, cam section 34 includes an indent into the outer side and/or face of the head 32 and may include first and second surfaces 35, 36. An arm 95 may extend outward from the head 32 to connect with the biasing mechanism 40 as will be described below.

The biasing mechanism 40 is operatively connected to the body 20 and the shutter 30. In one embodiment as illustrated in FIG. 1, biasing mechanism 40 includes a first attachment point 41 connected to the body 20, and a second attachment point 42 connected to the shutter 30. An intermediate section 43 is positioned between the attachment points 41, 42. In one embodiment, the biasing mechanism 40 is a torsion spring. In one embodiment, the attachment points 41, 42 are the ends of the biasing mechanism 40. In another embodiment, one or both attachment points 41, 42 are positioned inward from the ends.

The cartridge 10 is sized to fit within the image forming device 100. The cartridge 10 is vertically delivered into and removed from the image forming device 100. The construction of the cartridge 10 and the force of the biasing mechanism 40 cause the shutter 30 to move between the open and closed orientations.

Figure 4C:
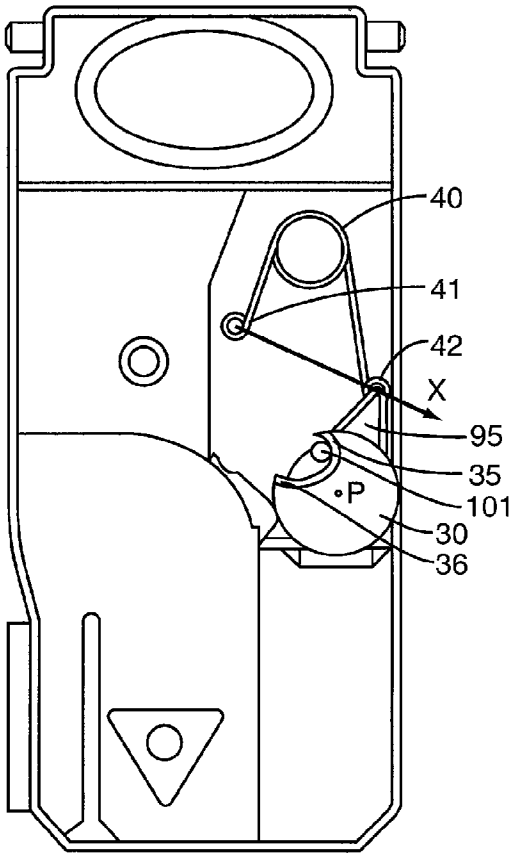
FIG. 4C is a side view of a cartridge in an open orientation according to one embodiment.
Figure 4B:
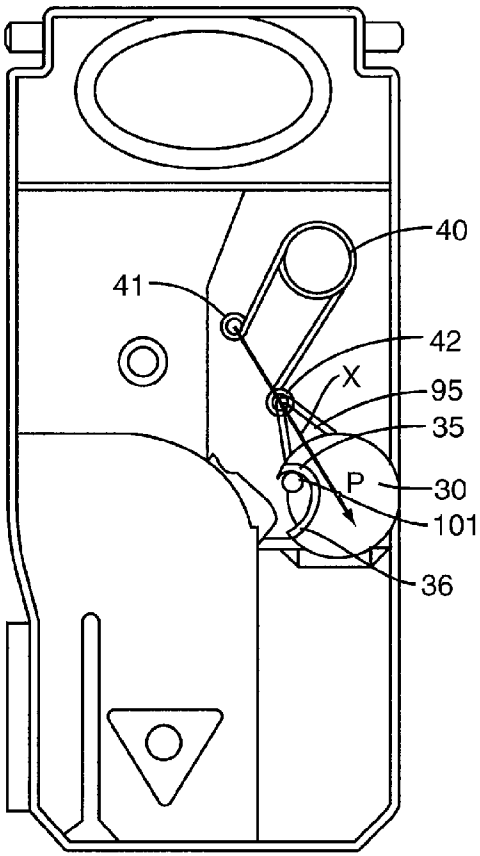
FIG. 4B is a side view of a cartridge with a shutter rotated to an intermediate point according to one embodiment.
Figure 4A:
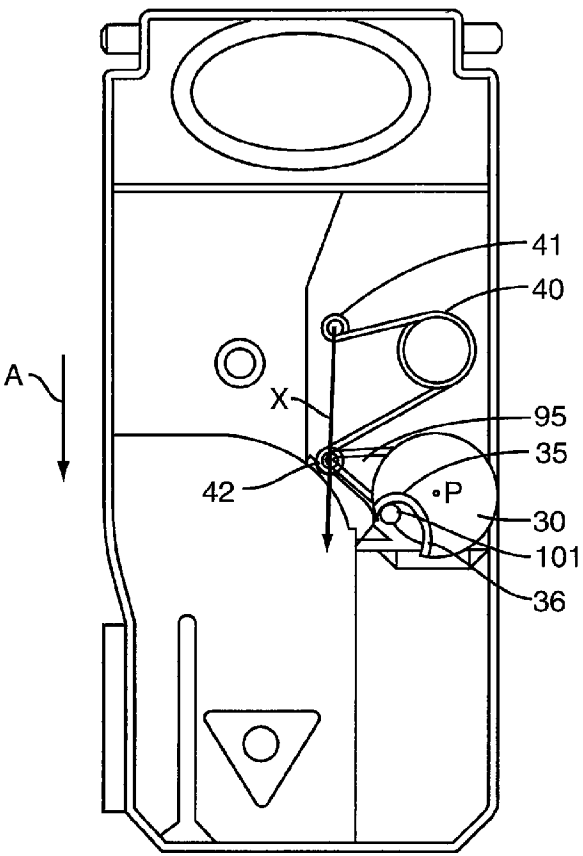
FIG. 4A is a side view of a cartridge in a closed orientation according to one embodiment.

FIGS. 4A-C illustrate one method of inserting the cartridge 10 into the image forming device 100. As illustrated in FIG. 4A, the shutter 30 is in the closed orientation prior to insertion of the cartridge 10 into the image forming device 100. The biasing mechanism 40 applies a force X that extends between the first and second attachment points 41, 42 to urge the shutter 30 towards the closed orientation and prevent inadvertent shutter movement towards the open orientation that may cause toner leakage.

While in the closed orientation, the cartridge 10 is inserted into the image forming device 100 in a vertical insertion direction indicated by arrow A. During insertion, the cam section 34 contacts a projection 101 (see FIG. 1) that extends from the image forming device 100. Vertical insertion in direction A causes the first surface 35 of the cam section 34 to contact the projection 101. The contact causes the shutter 30 to rotate in a clockwise direction against the urging force X of the biasing mechanism 40.

Continued insertion of the cartridge 10 causes the shutter 30 to continue to rotate in the clockwise direction as illustrated in FIG. 4B. The projection 101 remains in contact with the first surface 35 during continued rotation of the shutter 30. At an intermediate point as illustrated in FIG. 4B, the shutter 30 is rotated such that the attachment points 41, 42 are in closer proximity than in the closed and open orientations. Further, force X applied by the biasing mechanism 40 is applied along a line extending through the attachment points 41, 42 and a center point P of the shutter 30.

Continued insertion of the cartridge 10 causes the shutter 30 to rotate further in the clockwise direction beyond the intermediate point. This rotation beyond the intermediate point causes the force X to rotate the shutter 30 to the open orientation. As illustrated in FIG. 4C, the position of the attachment points 41, 42 is such that the force X is applied beyond the center point P of the shutter 30. This over-center force urges the shutter 30 to the open orientation. The cam section 34 may slide along the projection 101 from contact with the first surface 35 to contact with the second surface 36 when the shutter 30 moves to the open orientation.

In one embodiment, the cartridge 10 is fully inserted into the image forming device 100 immediately after the shutter 30 rotates beyond the intermediate point. In other embodiments, the cartridge 10 is further inserted a distance after the shutter 30 rotates beyond the intermediate point and moves to the open orientation.

In one embodiment, the opening 25 in the body 20 remains fully covered by the cylindrical section 31 until the shutter 30 moves from the intermediate point to the open orientation. In another embodiment, the opening 33 in the shutter 30 begins to partially align with the opening 25 in the body 20 at some point after the projection 101 contacts the cam section 34 and begins to rotate the shutter 30.

Removal of the cartridge 10 from the image forming device 100 causes the shutter 30 to move in a similar manner from the open orientation to the closed orientation. As the cartridge 10 is initially lifted vertically from the image forming device 100, the second surface 36 of the cam section 34 contacts against the projection 101. Continued vertical motion causes the shutter 30 to continue to rotate against the urging of the biasing mechanism 40 to and beyond the intermediate point. Once rotated beyond the intermediate point, the biasing mechanism 40 urges the shutter 30 to the closed orientation as illustrated in FIG. 4A.

FIG. 5 illustrates one embodiment of an image forming device 100. The image forming device 100 includes a media input tray 111 positioned in a lower section of a body 112. The media input tray 111 is sized to contain a stack of media sheets that will receive color and/or monochrome images. The media input tray 111 is preferably removable for refilling. A control panel 114 may be located on the front 113 of the body 112. Using the control panel 114, the user is able to enter commands and generally control the operation of the image forming device 100. For example, the user may enter commands to switch modes (e.g., color mode, monochrome mode), view the number of images printed, take the image forming device 100 on/off line to perform periodic maintenance, and the like.

A first toner transfer area 120 includes one or more imaging units 121 that are aligned horizontally extending from the front 113 to a back 115 of the body 112. Each imaging unit 121 includes a charging roll 122, a developer 123 that includes various paddles and rollers for stirring and moving toner and a developer roll 124, and a rotating photoconductive (PC) drum 125. The charging roll 122 forms a nip with the PC drum 125, and charges the surface of the PC drum 25 to a specified voltage such as −1000 volts, for example. A laser beam from a printhead 126 contacts the surface of the PC drum 125 and discharges those areas it contacts to form a latent image. In one embodiment, areas on the PC drum 125 illuminated by the laser beam are discharged to approximately −300 volts. The developer roll 124, which also forms a nip with the PC drum 125, then transfers toner particles from the cartridge 10 containing a supply of toner to the PC drum 125, to form a toner image. The toner particles are attracted to the areas of the PC drum 125 surface discharged by the laser beam from the printhead 126.

The cartridges 10 may be operatively connected to each of the developers 123 in toner transfer relationship, when the cartridges 10 are inserted into the imaging forming device 100. The cartridges 10 may be mounted and removed from the image forming device 100 independently from the imaging units 121. In one embodiment, the cartridges 10 each contain one of black, magenta, cyan, or yellow toner. Each of cartridges 10 may be substantially the same, or one or more of the cartridges 10 may hold different toner capacities. In one specific embodiment, the cartridge 10 containing the black toner has a higher capacity than the others. The cartridges 10 may mount from a top 116 of the image forming device 100, in a generally vertical direction, and may detach during removal with the imaging units 121 remaining within the image forming device 100.

An intermediate transfer mechanism (ITM) 130 is disposed adjacent to each of the imaging units 121. In this embodiment, the ITM 130 is formed as an endless belt trained about support roller 131, tension roller 132 and back-up roller 133. During image forming operations, the ITM 130 moves past the imaging units 121 in a clockwise direction as viewed in FIG. 5. One or more of the PC drums 125 apply toner images in their respective colors to the ITM 130. In one embodiment, a positive voltage field attracts the toner image from the PC drums 125 to the surface of the moving ITM 130.

The ITM 130 rotates and collects the one or more toner images from the imaging units 121 and then conveys the toner images to a media sheet at a second transfer area. The second transfer area includes a second transfer nip 140 formed between the back-up roller 133 and a second transfer roller 141.

A media path 144 extends through the image forming device 100 for moving the media sheets through the imaging process. Media sheets are initially stored in the input tray 111 or introduced into the body 112 through a manual feeder 148. The sheets in the input tray 111 are picked by a pick mechanism 143 and moved into the media path 144. In this embodiment, the pick mechanism 143 includes a roller positioned at the end of a pivoting arm. The roller rotates to move the media sheets from input tray 111 towards the second transfer area. In one embodiment, the pick mechanism 143 is positioned in proximity (i.e., less than a length of a media sheet) to the second transfer area with the pick mechanism 143 moving the media sheets directly from the input tray 111 into the second transfer nip 140. For sheets entering through the manual feeder 148, one or more rollers are positioned to move the sheet into the second transfer nip 140.

The media sheet receives the toner image from the ITM 130 as it moves through the second transfer nip 140. The media sheets with toner images are then moved along the media path 144 and into a fuser area 150. Fuser area 150 includes fusing rollers or belts 151 that form a nip to adhere the toner image to the media sheet. The fused media sheets then pass through exit rollers 145 that are located downstream from the fuser area 150. Exit rollers 145 may be rotated in either forward or reverse directions. In a forward direction, the exit rollers 145 move the media sheet from the media path 144 to an output area 147. In a reverse direction, the exit rollers 145 move the media sheet into a duplex path 146 for image formation on a second side of the media sheet.

In one embodiment, the biasing mechanism 40 is exposed on the exterior of the body 20. In another embodiment, a cover extends over a portion or entirety of the biasing mechanism 40.

Terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner cartridge for use with an image forming device comprising:

a body forming an enclosed reservoir to contain toner and an outlet in communication with the reservoir, the outlet including a substantially cylindrical first wall with a first opening extending through the first wall;

a cylindrical shutter sized to fit within the outlet, the shutter including a substantially cylindrical second wall and a second opening extending through the second wall; and a biasing mechanism attached to the body and the shutter to rotate the shutter relative to the body, the biasing mechanism rotating the shutter between a first orientation with the second wall aligned with the first opening to prevent toner from moving through the outlet and a second orientation with the second opening aligned with the first opening to allow toner to move through the outlet.

2. The cartridge of claim 1 wherein the body includes a top and a bottom when positioned within the image forming device, the outlet being positioned in an intermediate section between the top and bottom.

3. The cartridge of claim 2 wherein the first opening faces toward the bottom.

4. The cartridge of claim 1 wherein the shutter further includes a cylindrical section that includes the cylindrical second wall and the second opening and a head positioned at an end of the cylindrical section, the head including a greater width than the cylindrical section.

5. The cartridge of claim 4 further including an arm that extends outward from the head, the biasing mechanism being attached to the arm.

6. The cartridge of claim 4 further including a cam section positioned on an outer surface, the cam section including a first surface to contact the image forming device during insertion of the cartridge and a second surface to contact the image forming device during removal of the cartridge.

7. The cartridge of claim 4 wherein the head is positioned on an exterior of the body and the cylindrical section is positioned within an interior of the body.

8. The cartridge of claim 4 wherein the width of the head is greater than a width of the outlet.

9. The cartridge of claim 1 wherein the biasing mechanism includes a first point attached to the body and a second point attached to the shutter.

10. A toner cartridge for use with an image forming device comprising:

a body forming an enclosed reservoir to contain toner and an outlet in communication with the reservoir;

a shutter movable between a closed orientation to prevent toner from moving through the outlet and an open orientation to allow toner to move through the outlet; and a biasing mechanism including a first attachment point to the body and a second attachment point to the shutter, the biasing mechanism adapted to rotate the shutter through an intermediate orientation between the open and closed orientations, the first and second attachment points being in closest proximity at the intermediate orientation;

the biasing mechanism urging the shutter away from the intermediate orientation and towards one of the open and closed orientations.

11. The cartridge of claim 10 wherein the shutter is rotatably positioned within the outlet and rotatable between the open and closed orientations.

12. The cartridge of claim 10 wherein the shutter includes a cam section with a first surface to contact the image forming device during insertion of the cartridge and rotate the shutter in a first direction, and a second surface to contact the image forming device during removal of the cartridge and rotate the shutter in a second direction.

13. The cartridge of claim 12 wherein the cam section is formed on an exterior section of the shutter.

14. The cartridge of claim 10 wherein the shutter and the biasing mechanism are oriented in the intermediate orientation such that a line extends through the first and second attachment points and a center point of the shutter.

15. A toner cartridge for use with an image forming device comprising:

a body forming an enclosed reservoir to contain toner and an outlet in communication with the reservoir, the outlet including a substantially cylindrical first wall with a first opening extending through the first wall;

a shutter sized to fit within the outlet, the shutter including a substantially cylindrical second wall and a second opening extending through the second wall, the shutter rotatable between a closed orientation to prevent toner from moving through the outlet, an open orientation to allow toner to move through the outlet, and a third orientation between the open and closed orientations;

the shutter adapted to receive a first rotational force to move from the closed orientation to the third orientation and a second force to move from beyond the third orientation to the open orientation.

16. The cartridge of claim 15 wherein the third orientation is just beyond a center position of the shutter with the center position defined by a line that extends through first and second attachment points of a biasing mechanism and a center point of the shutter.

17. A toner cartridge for use with an image forming device comprising:

a body forming an enclosed reservoir to contain toner and an outlet in communication with the reservoir, the outlet including a substantially cylindrical first wall with a first opening extending through the first wall;

a shutter sized to fit within the outlet, the shutter including a substantially cylindrical second wall and a second opening extending through the second wall, the shutter rotatable between a closed orientation to prevent toner from moving through the outlet, an open orientation to allow toner to move through the outlet, and an intermediate orientation between the open and closed orientations; and a biasing mechanism operatively attached to the shutter and the body to rotate the shutter relative to the body, the biasing mechanism urging the shutter away from the intermediate orientation and towards one of the open and closed orientations.

18. The cartridge of claim 17 wherein a line extends through attachments points of the biasing mechanism and a center point of the shutter when the shutter is in the intermediate orientation.

19. The cartridge of claim 17 wherein the shutter further includes a head attached to an end of the cylindrical second wall, the head including a width greater than the outlet.

20. The cartridge of claim 17 wherein the shutter further includes a cam section to contact the image forming device during insertion and cause rotation of the shutter.

* * * * *